US008920208B2

(12) United States Patent
Elson

(10) Patent No.: US 8,920,208 B2
(45) Date of Patent: Dec. 30, 2014

(54) COLLAPSIBLE PLAY GYM

(75) Inventor: Brittany Elson, Atlanta, GA (US)

(73) Assignee: Kids II, Inc., Atlanta, GA (US)

( * ) Notice: Subject to any disclaimer, the term of this patent is extended or adjusted under 35 U.S.C. 154(b) by 168 days.

(21) Appl. No.: 13/606,169

(22) Filed: Sep. 7, 2012

(65) Prior Publication Data

US 2013/0065479 A1 Mar. 14, 2013

Related U.S. Application Data

(60) Provisional application No. 61/532,599, filed on Sep. 9, 2011.

(51) Int. Cl.
*A63H 33/00* (2006.01)

(52) U.S. Cl.
CPC ..... *A63H 33/006* (2013.01); *A63H 33/008* (2013.01)
USPC ..... 446/227; 5/655

(58) Field of Classification Search
USPC ..... 5/655; 135/136, 137, 138; 446/227
See application file for complete search history.

(56) References Cited

U.S. PATENT DOCUMENTS

| | | | | |
|---|---|---|---|---|
| 2,689,579 | A * | 9/1954 | Sartori | 135/133 |
| 2,829,660 | A * | 4/1958 | Wester et al. | 135/137 |
| 3,465,765 | A * | 9/1969 | Dietz | 135/137 |
| 5,930,854 | A * | 8/1999 | O'Neill et al. | 5/655 |
| 5,950,649 | A * | 9/1999 | Gerig | 135/125 |
| 6,178,978 | B1 * | 1/2001 | Rieber | 135/96 |
| 6,357,462 | B1 * | 3/2002 | Laosunthara et al. | 135/96 |
| 7,004,183 | B2 * | 2/2006 | Gillis | 135/124 |
| 7,376,993 | B2 * | 5/2008 | Myers et al. | 5/655 |
| 7,490,379 | B2 * | 2/2009 | Solomon et al. | 5/655 |
| 2006/0054208 | A1 * | 3/2006 | Romano | 135/132 |
| 2009/0253342 | A1 * | 10/2009 | Oren et al. | 446/227 |

* cited by examiner

*Primary Examiner* — John Ricci
(74) *Attorney, Agent, or Firm* — Gardner Groff Greenwald & Villanueva, PC

(57) ABSTRACT

A collapsible play gym for infants, the gym having a base and a bar assembly. The bar assembly includes an array of permanently attached flexible bars that are collapsible to a compact aligned configuration for storage and transport. The bars can be flexed into an upright configuration for suspending toys or other entertainment items over the base, and the bar assembly retained in the upright configuration by releasable attachments.

20 Claims, 4 Drawing Sheets

COLLAPSIBLE PLAY GYM

CROSS-REFERENCE TO RELATED APPLICATIONS

This application claims priority benefit to U.S. Provisional Patent Application Ser. No. 61/532,599 filed Sep. 9, 2011, the entirety of which is hereby incorporated by reference herein.

TECHNICAL FIELD

The present invention relates generally to the field of play equipment for children, and more particularly to a collapsible play gym for infants or small children.

SUMMARY

In example embodiments, the present invention provides a play gym for infants or small children, which includes a removable and collapsible arch structure for supporting toys, entertainment features and/or other items over a play mat area. The arch assembly includes two or more support bars linked at ends thereof, and having detachable couplings for removably attaching to the play mat. The arch assembly optionally includes an accordion-like assembly of three flexible support bars, each of the bars having one or more attachment loops or couplings for permanent or removable attachment of toys, entertainment features and/or other items.

In one aspect, the present invention relates to a play apparatus. The play apparatus preferably includes a base having a plurality of base coupling elements. The play apparatus preferably also includes a bar assembly having a plurality of bars and a connector sleeve or other non-permanent connection means for attaching the bars to one another to form the bar assembly, such as for example a socket, clamp, zipper, clip, magnets, hook-and-loop fasteners, Velcro strap, buckles, dovetail lock, a hook, ring that the bar slide through or other coupler, fastener or mating element, etc. At least one of the bars preferably has a free end for separable attachment with the connector sleeve. The bar assembly preferably further includes a plurality of bar assembly coupling elements for releasable connection with the plurality of base coupling elements.

In another aspect, the invention relates to a play apparatus. The play apparatus preferably includes a base having a first base coupling, a second base coupling and a third base coupling. The base couplings are preferably substantially evenly spaced about the base. The play apparatus preferably also includes a bar assembly having a first flexible bar with first and second ends, a second flexible bar with first and second ends, a third flexible bar with first and second ends, and a connector sleeve. The second end of the first flexible bar is preferably permanently attached to the first end of the second flexible bar, the second end of the second flexible bar permanently attached to the first end of the third flexible bar, and the connector sleeve permanently attached to the second end of the third flexible bar. The first end of the first flexible bar is preferably a free end removably engagable with the connector sleeve. A first bar assembly coupling preferably extends from the attached ends of the first and second flexible bars, a second bar assembly coupling preferably extends from the attached ends of the second and third flexible bars, and a third bar assembly coupling preferably extends from the attached third flexible bar and connector sleeve. The first bar assembly coupling is preferably releasably attachable to the first base coupling, the second bar assembly coupling releasably attachable to the second base coupling, and the third bar assembly coupling releasably attachable to the third base coupling, to secure the bar assembly to the base and retain the bar assembly in a flexed upright configuration.

In still another aspect, the invention relates to a method of assembling a play apparatus. The play apparatus includes a base and a bar assembly. The bar assembly includes an array of three connected bars and a connector sleeve. At least one of the bars has a free end, and the bars are generally linear in an unflexed state thereof. The assembly method preferably includes flexing the bars into a non-linear configuration, attaching connected ends of the three connected bars and the connector sleeve to the base, and attaching the free end to the connector sleeve.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
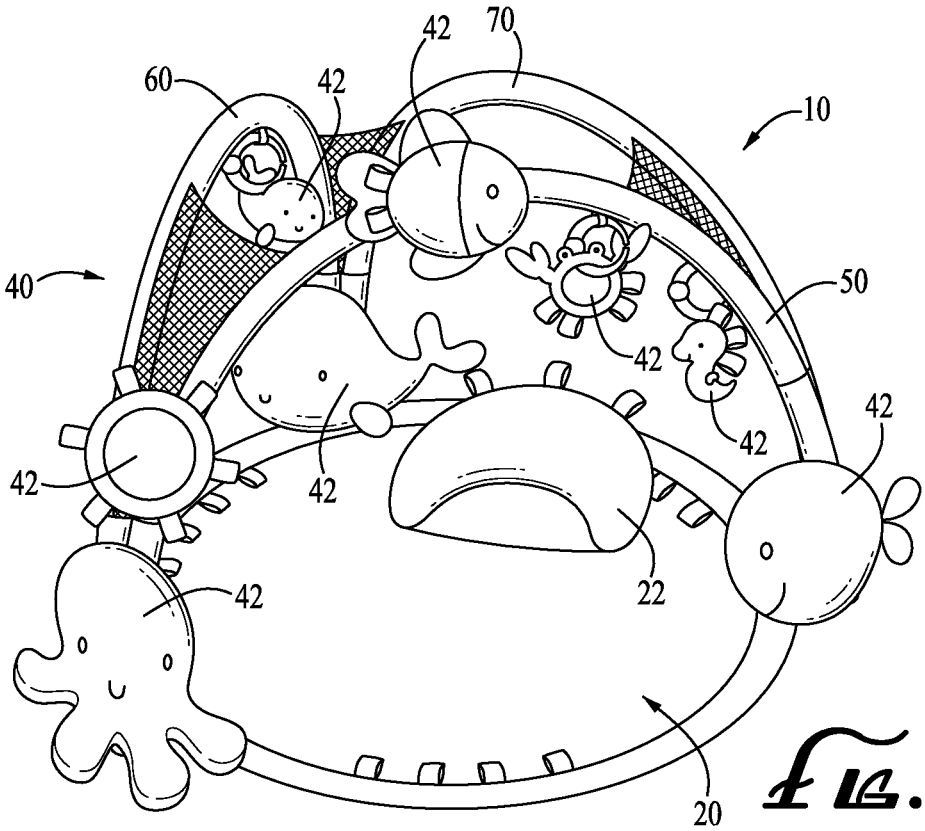
FIG. 1 is a perspective view of a play gym according to an example embodiment of the present invention.

With reference now to the drawing figures, wherein like reference numbers represent corresponding parts throughout the several views, FIG. 1 shows a play gym apparatus 10 according to an example embodiment of the invention. The play gym 10 generally comprises a base or mat 20 and a support bar assembly 40. An infant prop pillow 22 is optionally provided for repositionable or removable placement on the mat 20. In example embodiments, the base 20 comprises a panel or sheet formed of fabric, rubber or plastic, open or closed-cell foam, or other flexible material(s), or alternatively can comprise one or more rigid panels, and/or a hinged or foldable panel assembly. One or more toys, teethers, gripping rings, or other visual, tactile or audible entertainment features or other items 42 are optionally suspended from or otherwise permanently or detachably mounted to the support bar assembly 40 and/or the mat 20. In example embodiments, one or more fabric loops, rings, hook and loop fasteners, or other attachments 44 are provided for attachment of the items 42.

Figure 2:
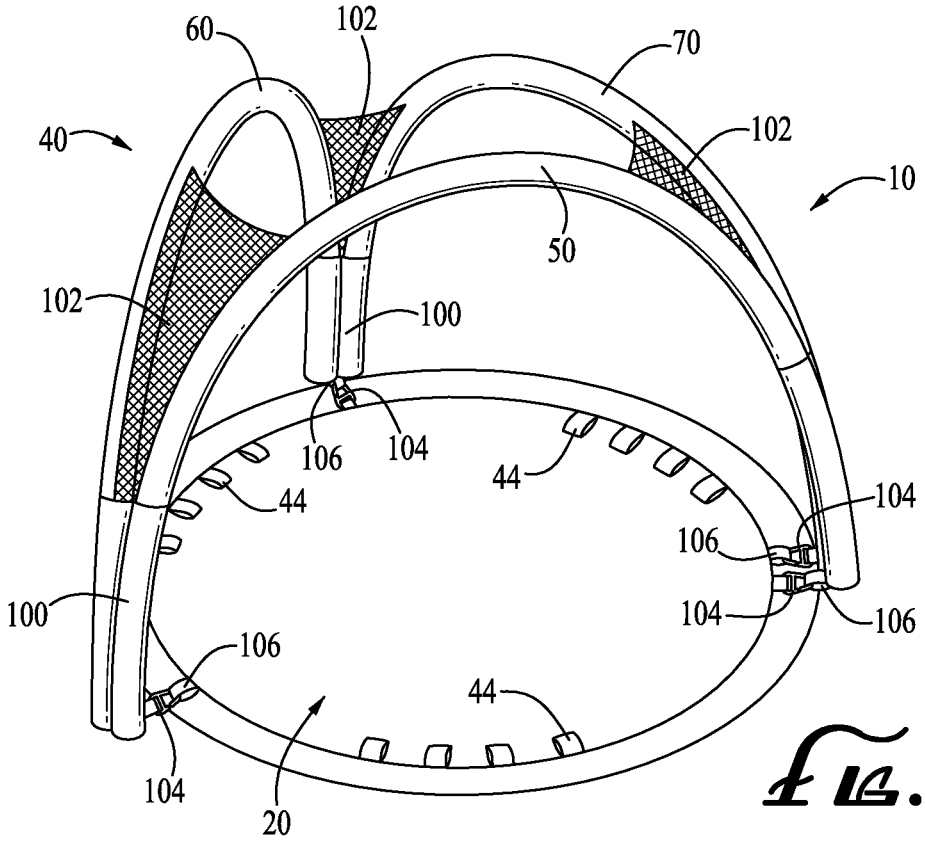
FIG. 2 is a perspective view of the play gym of FIG. 1 with attachments removed to more clearly view its mat and support bar structure.
Figure 3:
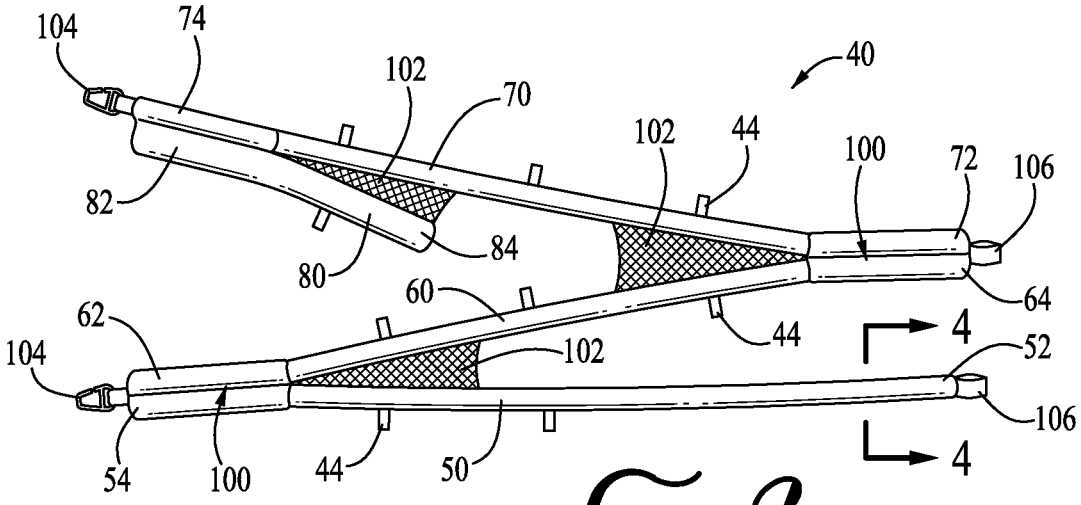
FIG. 3 is an assembly view of the support bar portions of the play gym of FIG. 1.

The support bar assembly 40 can be better seen in FIG. 2, which shows the play gym apparatus 10 with toys 42 removed, and in FIG. 3 which shows the bar assembly 40 detached from the mat 20 and partially collapsed. The bar assembly 40 is preferably detachable from the mat 20, and the bar assembly 40 and mat 20 are foldable, collapsible and/or compressible to allow for compact and generally flat storage and transport when disassembled. The bar assembly 40 and/or the mat 20 optionally comprise one or more quick-connect couplings to enable fast and easy set-up and take-down without the need for tools or other equipment. The bar assembly 40 and/or the mat 20 can be formed of resilient material(s) of construction, allowing for many use cycles of assembly and disassembly without permanent deformation or damage to the components thereof.

Figure 4:
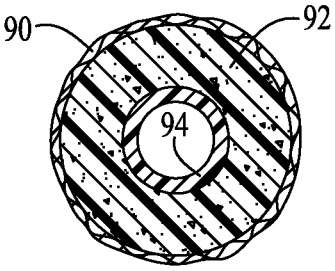
FIG. 4 is a cross-sectional view of a support bar of the play gym of FIG. 1, according to an example form.

The bar assembly 40 generally comprises a first bar 50, a second bar 60, a third bar 70, and a releasable connection sleeve 80. The bars 50, 60, 70 are preferably elongate tubular or cylindrical bodies, but in alternate designs may comprises one or more segments or sections, and may define circular, elliptical, rectangular, square or polygonal cross-sectional profiles. The bars 50, 60, 70 are preferably flexible along substantially all or at least a portion of their lengths, but alternatively may comprise hinged or rigid elements or a combination of rigid, flexible, and/or hinged bars. In the example embodiment shown in the cross-sectional view of FIG. 4, the bars 50, 60, 70 comprise a poly-pongee fabric shell 90, surrounding a compressible polyurethane foam padding 92, around an extruded flexible polypropylene or polyethylene tube 94 with a hollow core. In alternate embodiments, a flexible fiberglass rod may be used in place of the tube 94, and/or the bars can be formed from steel, molded plastic and/or other materials. The fabric shell 90 optionally comprises a moisture-repellant and stain-resistant material or coating. The bars 50, 60, 70 preferably have a continuous and uniform stiffness along their length, providing a degree of flexure allowing assembly as described herein upon application of a light to medium hand pressure.

The first bar 50 has a first or free end 52 and an opposite second end 52, which is attached to a first end 62 of the second bar 60. Similarly, a second end 64 of the second bar 60 is attached to a first end 72 of the third bar 70, and a second end 74 of the third bar is attached to a first end 82 of the connection sleeve 80. A second end 84 of the connection sleeve 80 comprises an open receiver communicating with an internal chamber or channel of the connection sleeve, which has an inner diameter or other dimension selected to receive the first end 52 of the first bar with a free-running friction or slight interference fit whereby the compressible foam 92 of the first bar serves to retain the assembly in place but allows easy insertion and removal. In further alternate embodiments, other releasable connection or attachment means may be used in place of the connection sleeve for attaching the bars to one another to form the bar assembly, such as for example one or more sockets, clamps, zippers, clips, magnets, hook-and-loop fasteners, Velcro straps, buckles, dovetail locks, hooks, rings that the bars slide through or other couplers, fasteners or mating elements, etc. In their unflexed state, the bars 50, 60, 70 and the connection sleeve 80 lie generally flat and parallel to one another in a compact assembly. The connections between the first and second bars and between the second and third bars results in a generally Z-shaped bar assembly as seen with reference to FIG. 3, when the ends of the bars are spread apart in the same plane.

Bar attachment sleeves 100 securely and permanently or semi-permanently attach the first bar 50 to the second bar 60 and the second bar to the third bar 70. The bar attachment sleeves 100 preferably allow a degree of rotational movement between the attached bars, but resist relative axial movement between the bars and/or removal of the bars from the sleeves. Alternatively the bars may be connected by hinges to allow for rotational movement between attached bars. In alternate embodiments, the connected ends of bars 50, 60 and bars 60, 70 are removably, semi-permanently or permanently attached together by snaps, ties, sleeves, hook-and-loop fasteners, buckles, hinges, sockets, fasteners or other attachment means. A retention panel of elastic mesh or netting 102 is optionally attached between the first bar 50 and the second bar 60 proximal the attached ends, and extending beyond the attachment sleeve 100 toward a medial segment of the bars. Panels of mesh or netting 102 are similarly attached between the second and third bars 60, 70, and between the third bar and the connection sleeve 80.

Couplings such as clips 104 or loops 106 are secured at respective ends of the bars, for removable attachment with cooperative couplings of the base 20. In example embodiments, such as that shown in FIG. 3, the couplings of the bar assembly 40 alternate between clips 104 and loops 106, and the counterpart couplings of the base 20 alternate between loops and clips in opposed fashion, so that a clip of the bar assembly couples to a loop of the base, and vice-versa, in an alternating array. In alternate forms, all couplings of the bar assembly 40 comprise clips 104 and all couplings of the base 20 comprise loops (or vice-versa). Alternative embodiments may attach the bar assembly 40 to the base 20 using snaps, ties, hook-and-loop fasteners, buckles, fasteners, sockets, or other removable attachment means.

The play gym apparatus 10 is assembled into the configuration shown in FIGS. 1 and 2 by flexing the bars and attaching clips 104 at bar ends 62 and 82 to corresponding loops 106 of the base 20, and by attaching loop 106 at bar end 72 to a corresponding clip 104 of the base. The first bar 50 is then flexed, and its free end 52 inserted into the receiver opening 84 of the connecting sleeve 80. The free end 52 is passed through the connecting sleeve 80 until its loop 106 extends out from the end 82 of the sleeve, and the loop is attached to a corresponding clip 104 of the base 20. In this embodiment, the base 20 includes a clip 104 and a loop 106 immediately adjacent one another at one position along the periphery of the base, which is aligned with the position of the connecting sleeve 80 for assembly.

In alternate embodiments, a bar assembly comprising four or more bars can be provided for attachment to four or more coupling locations on the base in similar fashion. In the depicted three-bar embodiment, the coupling locations are approximately equally spaced about the periphery of the base, at 120° intervals, and the bars are of substantially equal length, resulting in a generally symmetric bar assembly. In a four-bar embodiment, equal coupling spacing of 90° (or 360°/x intervals for a bar assembly of x number of bars) can be provided. Alternatively, the coupling spacing can be unequal, and/or the bars of unequal lengths, resulting in an asymmetric bar assembly.

Figure 5A:
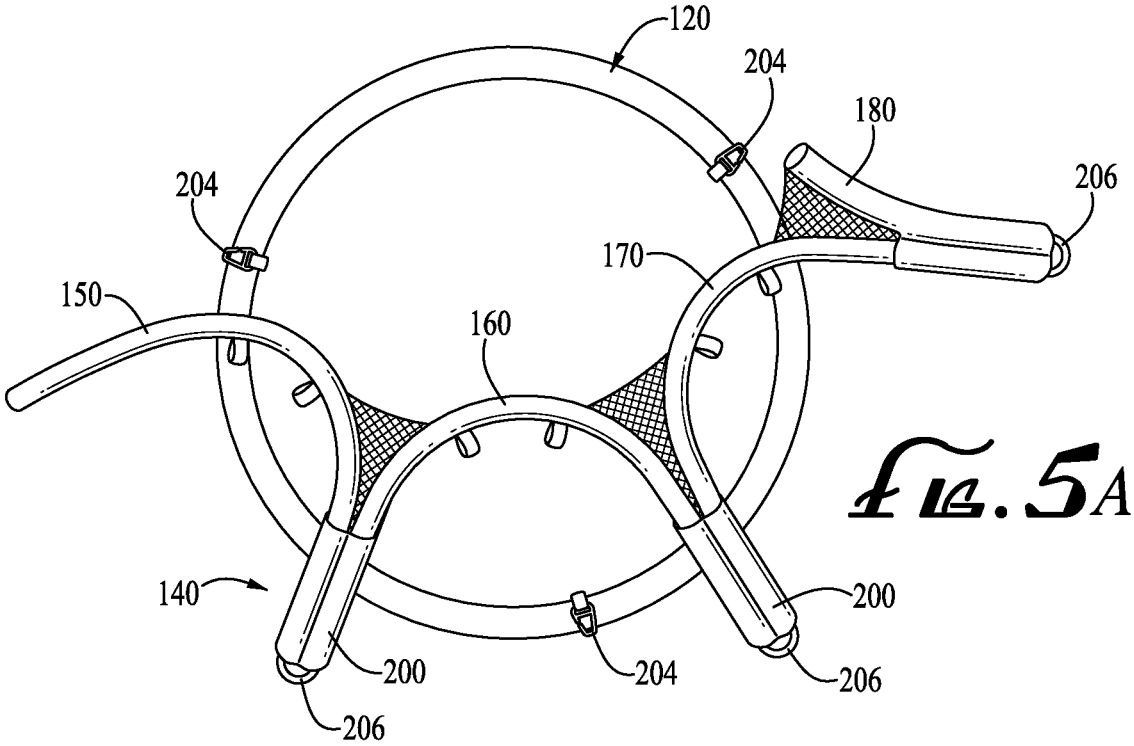
FIGS. 5A-5D show a sequence of assembly of a play gym according to another example embodiment of the invention.
Figure 5B:
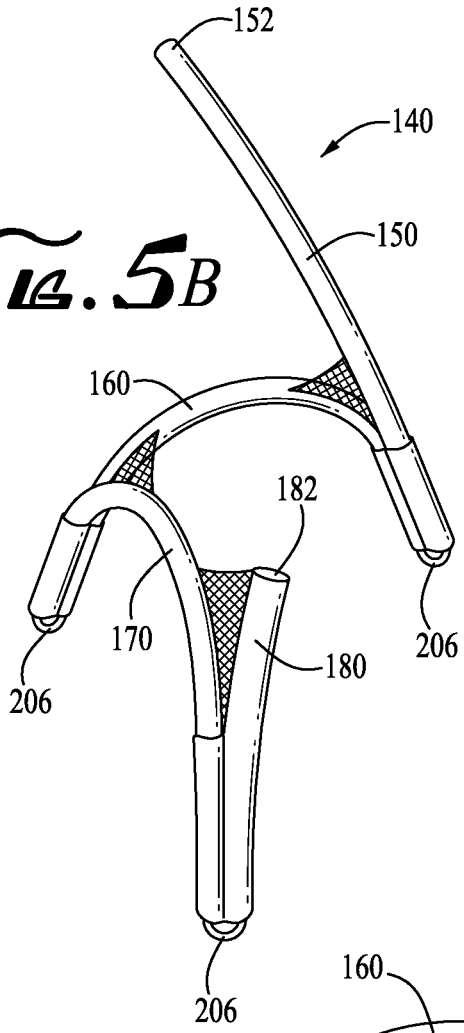
Figure 5C:
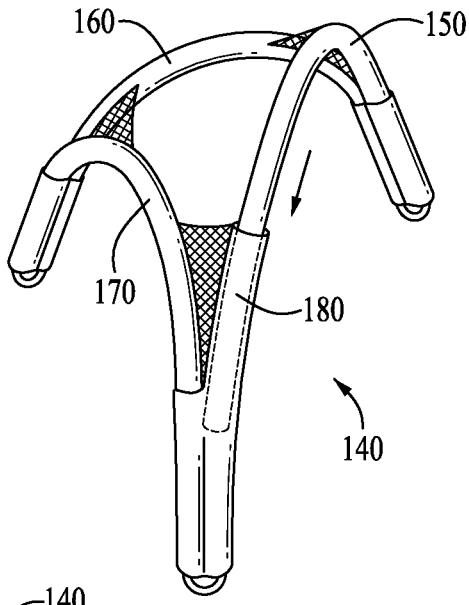
Figure 5D:
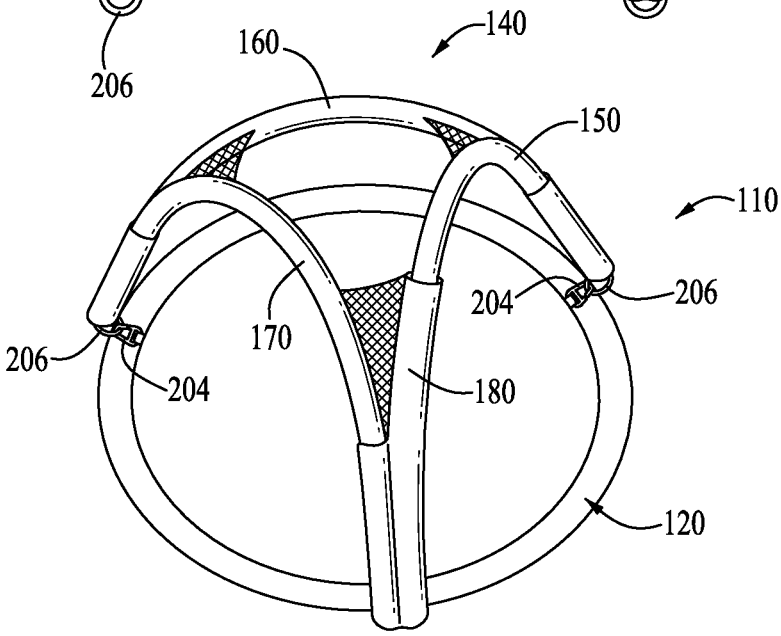

FIGS. 5A-5C show a sequence of assembly of another example embodiment of a play gym 110 according to the present invention. The depicted embodiment is substantially similar to that described above, having a base or mat 120 and a bar assembly 140. The bar assembly 140 comprises a first bar 150, a second bar 160, a third bar 170, and a connector sleeve 180. Adjacent ends of the first and second bars 150, 160 and of the second and third bars 160, 170 are attached to one another by bar attachment sleeves 200. In their unflexed state, bars 150, 160, 170 and connector sleeve 180 lie generally flat and straight, in a compact and generally parallel array. Clips 204 on the base releasably couple to loops 206 at the connected bar ends of the bar assembly. Loops 206 optionally comprise a non-woven or other fabric material, cord, rope, plastic or other flexible or rigid material. The loops each have first and second legs, each leg attached to or extending from an end of one of the bars 150, 160, 170 or from the connector sleeve 180, and a medial loop portion between the first and second legs In example form, the play gym 110 is assembled according to the assembly sequence depicted in FIGS. 5A-5D. The bars 150, 160, 170 are flexed, for example as shown in FIG. 5A, to allow connection of each loop 206 with a respective clip 204 of the base 120. The free end 152 of bar 150 is inserted into the receiver 182 of the connector sleeve 180, for example, as shown in FIGS. 5B and 5C, to complete the assembly, as shown in FIG. 5D. One or more toys, teethers, gripping rings, or other visual, tactile or audible entertainment features or other items can optionally be suspended or otherwise attached to the bar assembly. An infant or small child is placed on the mat 120 within the space bounded by the bar assembly, in position to play with the bar assembly and/or items attached thereto. The assembly can be disassembled by withdrawing the end 152 of bar 150 from the connection sleeve 180, and detaching the loops 206 from the clips 204, and the disassembled components folded or otherwise compacted for storage and transport.

Figure 6A:
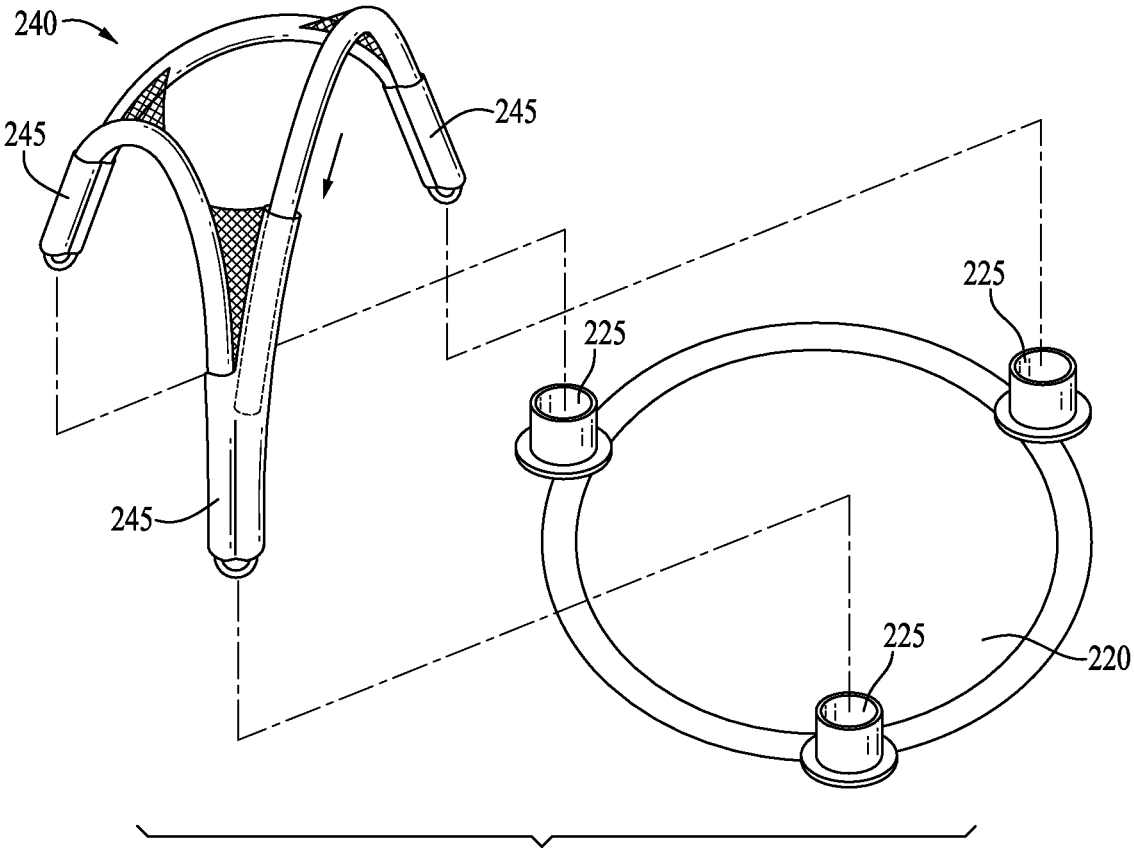
FIGS. 6A and 6B show partially disassembled and assembled views of a play gym according to another example embodiment of the invention.
Figure 6B:
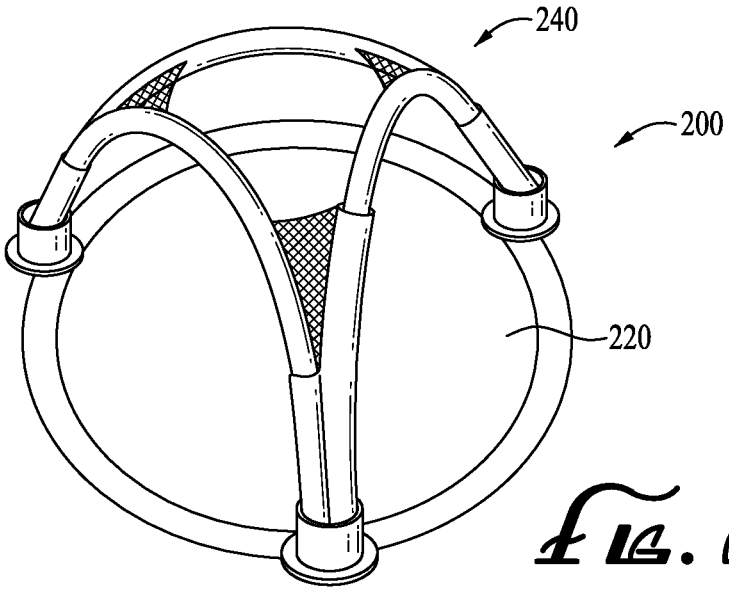

FIGS. 6A and 6B show another example embodiment of a play gym 200 according to the present invention. In this embodiment, the base 220 includes sockets 225 for receiving and engaging ends 245 of the bar assembly 240. The sockets 225 preferably receive the bar ends 245 with a snug friction fit that is engagable and detachable with moderate hand pressure. The depth of the sockets is selected to provide stability to the bars, for example a socket depth of at least about one-half to two times the diameter of the bar ends 245, and preferably about equal to the bar end diameter. The sockets can be permanently, semi-permanently or removably coupled to the mat, for example by adhesive, integral fabrication, solvent bonding, fasteners, hook-and-loop material, or the like. In alternate forms, the sockets are fixedly connected to the bar ends, and attach to the mat with detachable couplings such as clips, magnets, hook-and-loop material, fasteners, or the like.

While the invention has been described with reference to preferred and example embodiments, it will be understood by those skilled in the art that a variety of modifications, additions and deletions are within the scope of the invention, as defined by the following claims.

What is claimed is:

1. A play apparatus comprising:

a base comprising a plurality of base couplings elements; and a bar assembly comprising a plurality of bars and connection means for joining the plurality of bars into the bar assembly, at least one of the bars having a free end for separable attachment with the connection means, the bar assembly further comprising a plurality of bar assembly coupling elements for releasable connection with the plurality of base coupling elements, wherein the base coupling elements and the bar assembly coupling elements comprise a plurality of coupling pairs, each coupling pair comprising a clip element and a loop element.

2. The play apparatus of claim 1, wherein the bar assembly comprises a first bar, a second bar and a third bar, adjacent ends of the first and second bars and of the second and third bars being attached to one another, the first bar comprising the free end, and the connection means being attached to the third bar.

3. The play apparatus of claim 2, wherein the attached adjacent ends of the first and second bars, and of the second and third bars, are permanently attached.

4. The play apparatus of claim 2, further comprising bar attachment sleeves attaching the adjacent ends of the first and second bars, and of the second and third bars.

5. The play apparatus of claim 2, further comprising a retention panel between the first and second bars, and between the second and third bars, proximal the attached adjacent ends thereof.

6. The play apparatus of claim 1, wherein the bars comprise flexible elongate members.

7. The play apparatus of claim 6, wherein the flexible elongate members comprise a flexible core element surrounded by a compressible padding layer.

8. The play apparatus of claim 1, further comprising at least one entertainment feature mounted to the bar assembly.

9. The play apparatus of claim 8, wherein the bar assembly comprises a plurality of attachment loops for suspending the at least one entertainment feature therefrom.

10. The play apparatus of claim 1, wherein the connection means comprises a connector sleeve having a receiver for receiving and retaining the free end of the bar therein.

11. A play apparatus comprising:

a base having a first base coupling, a second base coupling and a third base coupling, the base couplings being substantially evenly spaced about the base; and a bar assembly comprising a first flexible bar having first and second ends, a second flexible bar having first and second ends, a third flexible bar having first and second ends, and a connector sleeve;

wherein the second end of the first flexible bar is permanently attached to the first end of the second flexible bar, the second end of the second flexible bar is permanently attached to the first end of the third flexible bar, and the connector sleeve is permanently attached to the second end of the third flexible bar, and wherein the first end of the first flexible bar is a free end removably engagable with the connector sleeve; and wherein a first bar assembly coupling extends from the attached ends of the first and second flexible bars, a second bar assembly coupling extends from the attached ends of the second and third flexible bars, and a third bar assembly coupling extends from the attached third flexible bar and connector sleeve, the first bar assembly coupling being releasably attachable to the first base coupling, the second bar assembly coupling being releasably attachable to the second base coupling, and the third bar assembly coupling being releasably attachable to the third base coupling to secure the bar assembly to the base and retain the bar assembly in a flexed upright configuration;

wherein the base couplings and the bar assembly couplings comprise a plurality of coupling pairs, each coupling pair comprising a clip element and a loop element.

12. The play apparatus of claim 11, further comprising a plurality of entertainment features mounted to the bar assembly.

13. The play apparatus of claim 11, further comprising bar attachment sleeves attaching the second end of the first flexible bar to the first end of the second flexible bar, the second end of the second flexible bar to the first end of the third flexible bar, and the connector sleeve to the second end of the third flexible bar.

14. The play apparatus of claim 11, further comprising a retention panel between the first and second bars, between the second and third bars, and between the third bar and the connection sleeve.

15. The play apparatus of claim 11, wherein each of the first, second and third bars comprise a flexible core element surrounded by a compressible padding layer.

16. The play apparatus of claim 11, wherein the connector sleeve comprises a receiver for receiving and retaining the free end of the first bar.

17. A method of assembling a play apparatus, the play apparatus comprising a base and a bar assembly, the bar assembly comprising an array of three connected bars and connection means for maintaining the bars in the bar assembly, at least one of the bars having a free end, the bars being generally linear in an unflexed state thereof, the method comprising flexing the bars into a non-linear configuration, attaching connected ends of the three connected bars and the connection means to the base, and attaching the free end to the connection means.

18. The assembly method of claim 17, wherein the step of attaching connected ends of the three connected bars and the connection means to the base comprises releasably coupling a plurality of base coupling elements with a plurality of corresponding bar assembly coupling elements.

19. The assembly method of claim 17, wherein the connection means comprises a connector sleeve, and the step of attaching the free end to the connection means comprises inserting the free end into a receiver of the connector sleeve.

20. A play apparatus comprising:

a base; and a bar assembly, the bar assembly comprising an array of three connected bars and connection means for maintaining the bars in the bar assembly, at least one of the bars having a free end, the bars being generally linear in an unflexed state thereof, wherein the bars flex into a non-linear configuration for assembly, and the connection means of the three connected bars attach to the base, and the free end attaches to the connection means.

* * * * *